US006072132A

United States Patent [19]

Turner

[11] Patent Number: 6,072,132

[45] Date of Patent: Jun. 6, 2000

[54] APPARATUS FOR MOUNTING A MOTOR OPERATOR ON A CIRCUIT

[75] Inventor: David Curtis Turner, Imperial, Pa.

[73] Assignee: Eaton Corporation, Cleveland, Ohio

[21] Appl. No.: 09/406,998

[22] Filed: Sep. 28, 1999

[51] Int. Cl.[7] ..... H01H 3/00; H01H 9/00

[52] U.S. Cl. ..... 200/330; 200/400; 335/68

[58] Field of Search ..... 200/17 R, 400, 200/401, 500, 501, 330, 331, 293, 295, 307; 335/65, 68–72; 361/600, 601, 605, 615, 616, 631, 632, 634, 641, 643, 735, 724–730

[56] References Cited

U.S. PATENT DOCUMENTS

| | | | |
|---|---|---|---|
| 4,085,622 | 4/1978 | Gryctko et al. | 74/53 |
| 4,553,115 | 11/1985 | Grunert et al. | 335/14 |
| 4,642,726 | 2/1987 | Matsko et al. | 361/198 |
| 4,990,873 | 2/1991 | Grunert et al. | 335/68 |
| 5,196,658 | 3/1993 | Gula | 200/50 R |
| 5,323,131 | 6/1994 | Castonguay | 335/68 |
| 5,362,933 | 11/1994 | Kutsche et al. | 200/401 |
| 5,428,196 | 6/1995 | Beatty, Jr. et al. | 200/329 |
| 5,652,420 | 7/1997 | Innes et al. | 200/50.32 |
| 5,693,923 | 12/1997 | Gula et al. | 200/50.26 |
| 5,695,046 | 12/1997 | Turner et al. | 200/330 |
| 5,700,985 | 12/1997 | Fischer et al. | 200/50.01 |
| 5,905,239 | 5/1999 | Turner et al. | 200/330 |

*Primary Examiner*—Michael Friedhofer
*Attorney, Agent, or Firm*—Martin J. Moran

[57] ABSTRACT

An apparatus for mounting a motor operator on a circuit breaker comprising two mounting bracket portions, each lying in a plane generally perpendicular to a face of a circuit breaker housing, and a device for slideably coupling the motor operator to the bracket portions, thereby permitting the motor operator to slide between the mounting brackets in a direction substantially perpendicular to the face of the circuit breaker housing.

9 Claims, 3 Drawing Sheets

APPARATUS FOR MOUNTING A MOTOR OPERATOR ON A CIRCUIT

BACKGROUND OF THE INVENTION

The present invention relates to electric operators for use with molded case circuit breakers, switches and the like and, more particularly, to mounting assemblies for attaching electric operators to circuit breakers, switches and the like.

Molded case circuit breakers are generally used to provide overcurrent protection for various types of electrical equipment. However, in some applications, it is necessary to control circuit breakers from a remote location. In such applications, electric operators may be provided that are adapted to be mechanically coupled to the operating handle of the circuit breaker. Electric operators typically include an actuator, adapted to be mechanically coupled to a circuit breaker operating handle, for moving the operating handle to an open position or, alternatively, to a closed position; an electric motor for driving the actuator and allowing the circuit breaker to be controlled from a remote location; and some means that allows for manual operation of the actuator in the event of a loss of electric power to the electric motor.

Both solenoid operators and motor operators are known. Examples of solenoid operators for molded case circuit breakers and switches are disclosed in U.S. Pat. Nos. 4,553,115 and 4,642,726. Motor operators for electrical operation of the handles of switches, particularly switches such as circuit breakers and contactors, are well known. Many such devices have an actuator forming a slot that engages the switch handle. Typically, the actuator is mounted on a threaded shaft rotated by an electric motor. It is common for the mounting of the motor operator to the switch to be such that once the motor operator is in place, the switch handle is not accessible for manual operation. In these installations, some form of manual operation is provided, such as a crank that rotates the threaded shaft in place of motor operation.

Both solenoid operators and motor operators are adapted to be rigidly mounted relative to the circuit breaker or molded case switch to facilitate movement of the operating handle. Such operators may either be disposed within the circuit breaker or switch housing or mounted either on the side or in the front of the circuit breaker. Irrespective of the mounting arrangement of the electric operator relative to the circuit breaker or switch, the electric operator must include means for manual operation in the event of loss of electric power to the electric operator.

One motor operator assembly shown in U.S. Pat. No. 5,323,131, includes a motor operator unit hinged at one end to a mounting bracket secured to the switch adjacent to the switch handle so that the motor operator unit may be readily rotated between an operative position in which it engages the switch handle for electrical operation of the switch, and a manual position in which the motor operator is rotated clear of the handle thereby providing direct access to the switch handle for manual operation.

Hinged motor operator mounting assemblies, such as shown in U.S. Pat. No. 5,693,923, have been used to permit access to the circuit breaker handle. Since circuit breakers can be mounted vertically or horizontally, a hinged connection may allow the motor operator to swing into proximity of live electrical conductors connected to the breaker or adjacent breakers, thereby creating an unsafe condition. In addition, if the hinge is positioned improperly due to the orientation of the breaker, excessive force may be placed on the hinge causing it to be damaged.

There is a need for a motor operator mounting arrangement that easily provides direct access to the switch handle for manual operation of the breaker without the disadvantages of a hinged coupling.

SUMMARY OF THE INVENTION

This invention provides an apparatus for mounting a motor operator on a circuit breaker comprising two mounting bracket portions, each lying in a plane generally perpendicular to a face of a circuit breaker housing, and means for slideably coupling the motor operator to the bracket portions, thereby permitting the motor operator to slide between the mounting brackets in a direction substantially perpendicular to the face of the circuit breaker housing.

In the preferred embodiment, each of the mounting bracket portions defines at least one slot extending in a direction substantially perpendicular to the face of the circuit breaker housing and the motor operator is slideably coupled to the slots permitting the motor operator to slide in a direction substantially perpendicular to the circuit breaker housing.

The motor operator can be moved a sufficient distance away from the circuit breaker so that an operator can manually operate a handle on the circuit breaker.

DESCRIPTION OF THE PREFERRED EMBODIMENTS

Figure 1:
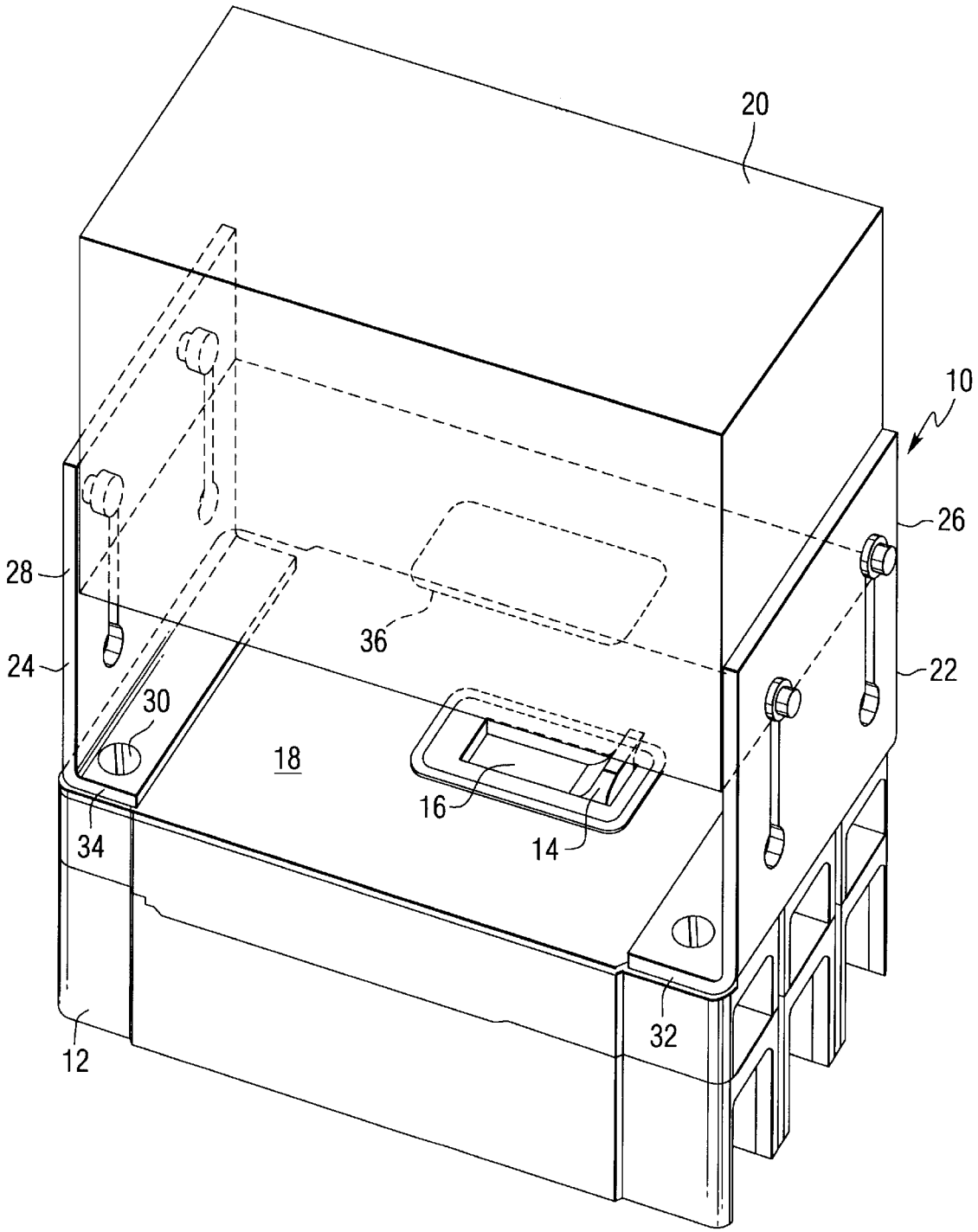
FIG. 1 is isometric view of a circuit breaker having a motor operator mounting apparatus constructed in accordance with the preferred embodiment of this invention.

Referring to the drawings, FIG. 1 is an isometric view of a circuit breaker having a motor operator mounting apparatus constructed in accordance with the preferred embodiment of this invention. A motor operator assembly 10 is used to operate a circuit breaker or switch such as the circuit breaker 12, shown having an operating handle 14 which extends through an elongated handle slot 16 in a face 18 of the circuit breaker. While the illustrative embodiment of the invention shows a motor operator in combination with a circuit breaker, it will be appreciated that the motor operator 10 is suitable for use with other types of electrical switches including contactors and motor starters. The motor operator assembly 10 includes a motor operator unit 20 and a pair of mounting brackets 22 and 24 for securing the motor operator unit 10 to the circuit breaker 12 for operation of the handle 14. The mounting brackets 22 and 24 include generally planar portions 26 and 28 that lie in planes that are generally perpendicular to the plane of the face 18 of the circuit breaker. The mounting brackets are secured to the face 18 of the circuit breaker by fasteners 30 extending through mounting flanges 32 and 34 projecting laterally from the generally planar portions 26 and 28. The mounting brackets 22 and 24 secure the motor operator to the circuit breaker such that a slot 36 in the bottom of the motor operator is aligned with the handle slot 16, with the switch handle 14 projecting through the slot in the motor operator.

It will be understood by those skilled in the art that although FIG. 1 shows the use of two mounting brackets, a single bracket having a base extending adjacent to the circuit breaker face, and two generally planar portions at each end that extend generally perpendicular to the face of the circuit breaker, could also be used.

Figure 2:
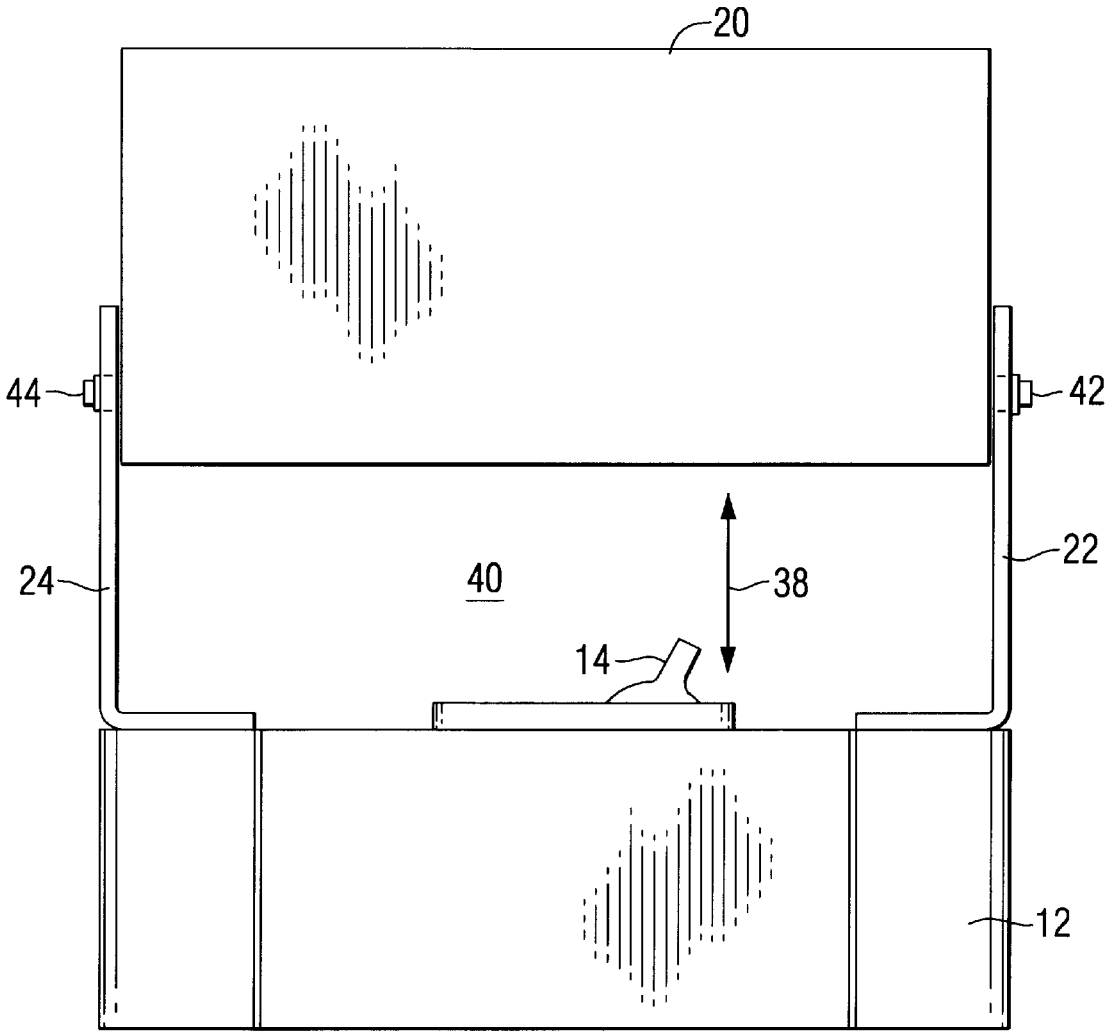
FIG. 2 is a side elevation view of a circuit breaker having a motor operator mounting apparatus constructed in accordance with the preferred embodiment of this invention.

FIG. 2 is a side elevation view of a circuit breaker having a motor operator mounting apparatus constructed in accordance with the preferred embodiment of this invention. This figure shows that the motor operator slides in a direction 38 that is substantially perpendicular to the face of the circuit breaker. When the motor operator is fully retracted, there is sufficient clearance in the space 40 for a person to insert his or her hand and operate the circuit breaker manually. The assembly is provided with means for slideably coupling the motor operator to the bracket portions, thereby permitting the motor operator to slide between the mounting brackets in a direction substantially perpendicular to the face of the circuit breaker housing. In this embodiment, the means for slideably coupling the motor operator to the bracket portions includes spring loaded plungers 42 and 44 that extend from the ends of the motor operator, in combination with slots in the mounting brackets. It should be understood that other types of slideable coupling arrangements could also be used.

Figure 3:
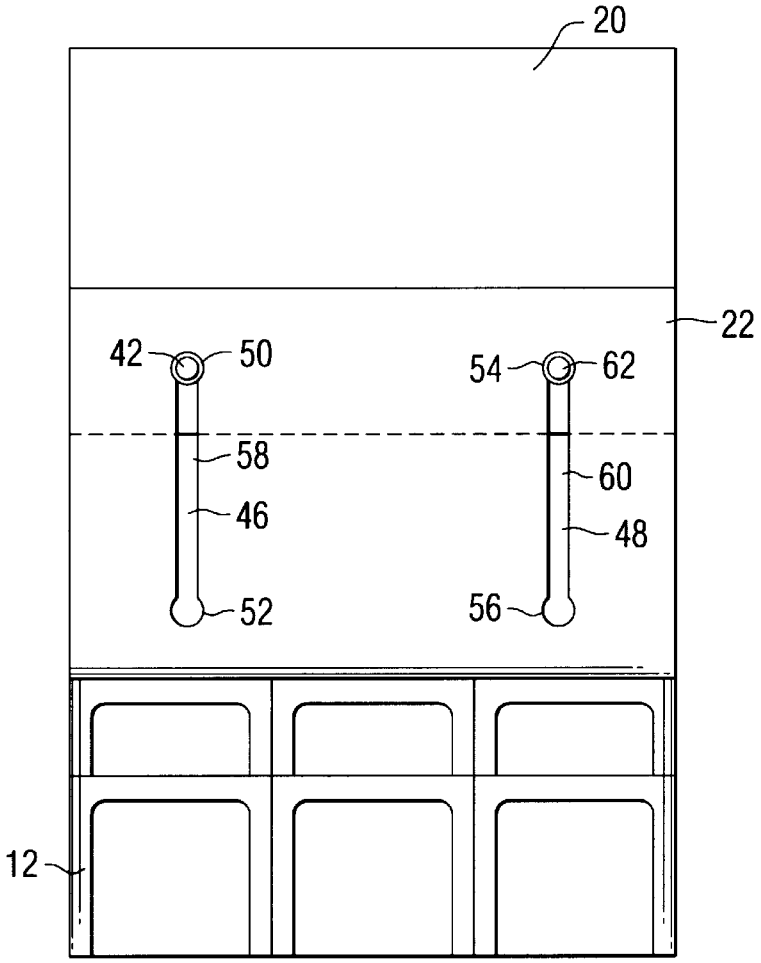
FIG. 3 is an end elevation view of a circuit breaker having a motor operator mounting apparatus constructed in accordance with the preferred embodiment of this invention.

FIG. 3 is an end elevation view of a circuit breaker having a motor operator mounting apparatus constructed in accordance with the preferred embodiment of this invention. In the preferred embodiment each generally planar portion of the mounting brackets defines two slots 46 and 48 that extend generally perpendicular to the face of the circuit breaker. The slots include enlarged portions 50, 52, 54 and 56 at each end. The slots include central portions 58 and 60, each having a width that is smaller than the diameter of the plungers 42 and 62. When the plungers are depressed toward the motor operator, the motor operator can slide along the slots. The enlarged portions have a sufficient diameter so that the plungers 42 and 62 can extend within the enlarged portion and lock the motor operator in place. A similar arrangement of slots is found in the opposite mounting bracket.

Figure 4:
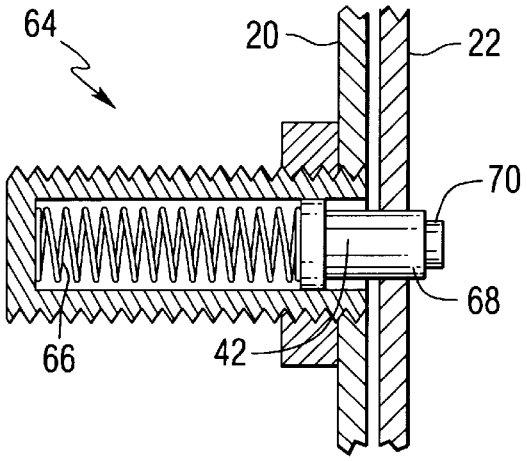
FIG. 4 is a detailed view, partially in section, of a release/locking pin engaged in one of the slots shown in FIG. 1.

FIG. 4 is a detailed view, partially in section, of a release/locking plunger assembly 64 with a plunger engaged in one of the slots shown in FIGS. 1, 2 and 3. The plunger assembly includes a plunger 42 and a spring 66 that forces the plunger to be in a normally extended state. The plunger includes a large diameter portion 68 that is sized to fit within the enlarged portion of the slots, and a small diameter portion 70 that fits within the narrow central section of the slots. This small diameter portion slides in the slots during movement of the motor operator and prevents lateral movement of the motor operator.

To utilize the invention, the release/locking pins would be disengaged from their locked position. In the preferred embodiment, this would be accomplished by depressing the pins so that they are no longer positioned in the enlarged portion of the slots. Then the motor operator can slide away from the circuit breaker handle, and move up the elongated slots to a position that provides sufficient clearance for manual operation of the circuit breaker handle. Then the motor operator can be locked in the retracted position. After the circuit breaker handle is manually operated, the motor operator handle engagement mechanism can be positioned properly to re-engage the handle. This repositioning can be accomplished, for example, by using a screwdriver to turn a threaded shaft in the motor operator that moves the handle engagement mechanism. Once the handle engagement mechanism is properly positioned, the release/locking pins can be depressed and the motor operator can slide toward the circuit breaker until it reaches its normal operating position. At that point, the plungers 42 and 62 would be positioned within enlarged openings 52 and 56, thereby locking the motor operator in a position adjacent to the circuit breaker housing.

This invention provides an apparatus that permits a motor operator to be disengaged from a circuit breaker and moved away a distance sufficient for a person to manually operate the breaker handle. While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the appended claims and any and all equivalents thereof.

I claim:

1. An apparatus for mounting a motor operator on a circuit breaker comprising:

two mounting bracket portions, each lying in a plane generally perpendicular to a face of a circuit breaker housing;

a motor operator positioned between the bracket portions; and means for slideably coupling the motor operator to the bracket portions, thereby permitting the motor operator to slide between the bracket portions in a direction substantially perpendicular to the face of the circuit breaker housing.

2. The apparatus of claim 1, wherein each of said mounting bracket portions defines a first slot extending in a direction substantially perpendicular to a face of a circuit breaker housing, and the apparatus further comprises:

means for coupling said motor operator to the first slots permitting said motor operator to slide in a direction substantially perpendicular to the breaker housing.

3. The apparatus of claim 2, wherein the means for coupling said motor operator to the slots comprises:

a plurality of spring loaded plungers, each of the plungers being attached to the motor operator and being positioned to extend into one of the first slots.

4. The apparatus of claim 3, wherein said first slots include means for locking said plungers in preselected positions.

5. The apparatus of claim 4, wherein said means for locking said pins in preselected positions comprises:

a plurality of enlarged portions in said first slots.

6. The apparatus of claim 2, wherein each of said mounting bracket portions further defines a second slot extending in a direction substantially perpendicular to a face of a circuit breaker housing, and the apparatus further comprises:

means for coupling said motor operator to the second slots permitting said motor operator to slide in a direction substantially perpendicular to the breaker housing.

7. The apparatus of claim 6, wherein the means for coupling said motor operator to the slots comprises a first plurality of spring loaded plungers, each of the first plurality of plungers being attached to the motor operator and being positioned to extend into one of the first slots; and wherein the means for coupling said motor operator to the second slots comprises a second plurality of spring loaded plungers, each of the second plurality of plungers being attached to the motor operator and being positioned to extend into one of the second slots.

8. The apparatus of claim 7, wherein the first slots each includes means for locking the first plurality of plungers in preselected positions; and the second slots each includes means for locking the second plurality of plungers in preselected positions.

9. The apparatus of claim 8, wherein said means for locking the first plurality of plungers in preselected positions in the first slots comprises a plurality of enlarged portions in the first slots; and wherein said means for locking the second plurality of plungers in preselected positions in the second slots comprises a plurality of enlarged portions in the second slots.

* * * * *